United States Patent [19]

Ito

[11] Patent Number: 4,951,092

[45] Date of Patent: Aug. 21, 1990

[54] COPYING MACHINE WITH DETACHABLE DEVELOPING DEVICE

[75] Inventor: Masazumi Ito, Osaka, Japan

[73] Assignee: Minolta Camera Kabushiki Kaisha, Osaka, Japan

[21] Appl. No.: 408,449

[22] Filed: Sep. 15, 1989

Related U.S. Application Data

[63] Continuation of Ser. No. 247,080, Sep. 21, 1988, abandoned.

[30] Foreign Application Priority Data

Sep. 22, 1987 [JP] Japan ..... 62-238363

[51] Int. Cl.[5] ..... G03G 15/00; G03G 15/06

[52] U.S. Cl. ..... 355/240; 355/245; 355/326

[58] Field of Search ..... 355/210, 218, 219, 245, 355/326, 200

[56] References Cited

U.S. PATENT DOCUMENTS 4,607,941 8/1986 Honda ..... 355/210
4,705,394 11/1987 Watanabe ..... 355/245
4,720,730 1/1988 Ito .
4,745,437 5/1988 Oka et al. .
4,785,331 11/1988 Oka et al. .
4,792,775 12/1988 Oka et al. .
4,794,062 12/1988 Oka et al. .
4,803,510 2/1989 Maeda ..... 355/210
4,803,512 2/1989 Ogura et al. ..... 355/219
4,821,071 4/1989 Oka et al. .
4,821,076 4/1989 Toyoshi et al. .
4,828,953 5/1989 Oka et al. .

FOREIGN PATENT DOCUMENTS 60-130782 7/1985 Japan .

*Primary Examiner*—R. L. Moses
*Attorney, Agent, or Firm*—Burns, Doane, Swecker & Mathis

[57] ABSTRACT

The present invention relates to a copying machine having a color developing function with a developing unit, outline image forming function with a outline image forming unit and a character writing function with a character writing unit. One of these units is selectively mountable on a mounting portion provided between the charging means and developing means of the copying machine.

10 Claims, 11 Drawing Sheets

COPYING MACHINE WITH DETACHABLE DEVELOPING DEVICE

This application is a continuation of application Ser. No. 247,080, filed Sept. 21, 1988, now abandoned.

BACKGROUND OF THE INVENTION

1. Field of the Invention

The present invention relates to copying machines having a color developing function, outline image forming function and character writing function.

2. Description of the Prior Art

Many copying machines have various functions in addition to the basic function. For example, copying machines are available which are equipped with two developing units with different toner colors and have a two-color copying function for giving copies in the two colors by the touch of a key. Also available are those wherein the photosensitive drum is provided with character writing means including a shutter and writing head (LED array) and which have the function of writing data in characters on copies (e.g. Japanese Laid-Open Patent Application No. 60-130782). Further known are those incorporating a charger between the point of exposure of the photosensitive drum and the developing unit for giving the copying machine the function of forming an outline image of a pattern (e.g. U.S. Pat. No. 745,437).

When such additional functions are to be provided, the devices for performing the functions (such as the second of the developing units, scorotron charger, LED array and the like) must be arranged around the photosensitive drum. In this case, if all of these devices are to be incorporated in the machine as standard equipment, the required space is not available around the photosensitive drum, or the machine has the drawback of being costly.

SUMMARY OF THE INVENTION

The main object of the present invention is to provide a copying machine readily adapted to have additional functions.

Another object of the invention is to provide a copying machine adapted to have additional functions without an increase in its size.

Another object of the invention is to provide a copying machine adapted to have additional functions economically advantageously without entailing a cost increase.

These and other objects can be fulfilled by a copying machine comprising charging means for charging a photosensitive member to a predetermined potential; optical means for projecting an image of an original onto the photosensitive member charged by the charging means to the predetermined potential to form an electrostatic latent image thereon; developing means for developing the latent image; and a mount portion provided between the position of image projection by the optical means and the developing means, one of a developing unit, a character writing unit and an outline image forming unit being selectively detachably mountable in the mount portion, the developing unit being operable as mounted in position to develop the latent image on the photosensitive member, the character writing unit being operable as mounted in position to form an electrostatic latent image of additional data on the photosensitive member, the outline image forming unit being operable as mounted in position to impart a specified potential to the latent image on the photosensitive member and extract only the outline of the latent image.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE INVENTION

An embodiment of the invention will be described below with reference to the accompanying drawings.

(a) Construction of copying machine

Figure 1:
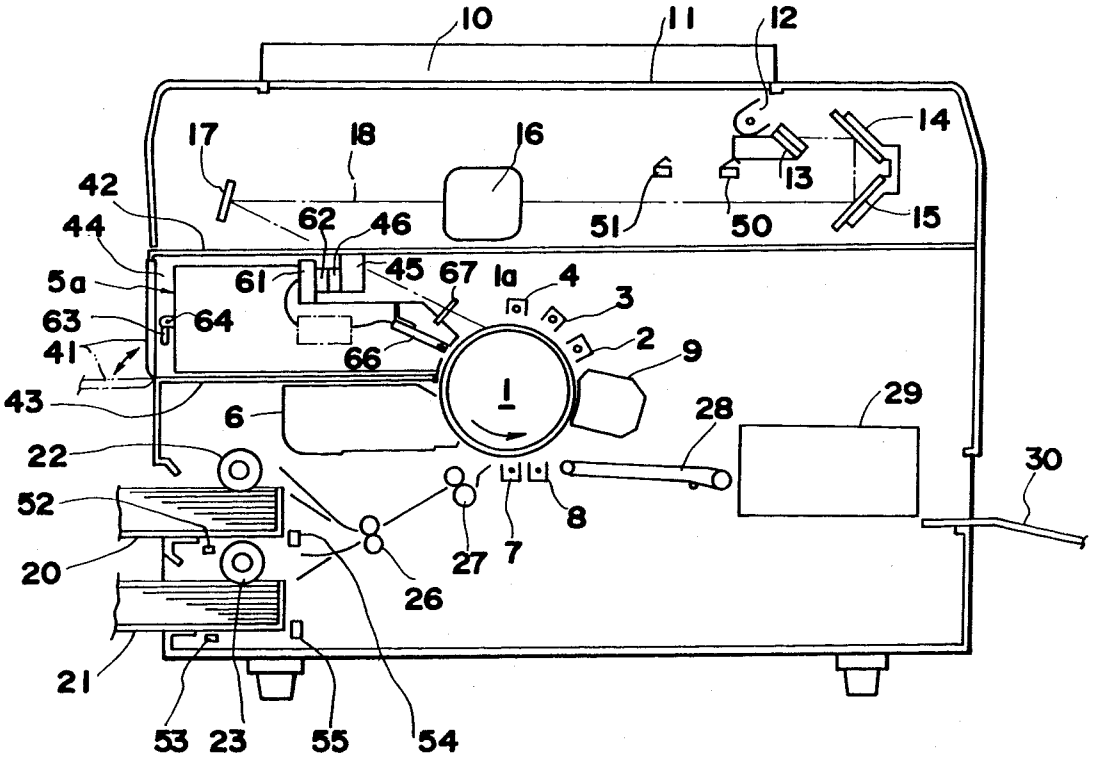
FIG. 1 is a sectional view of a copying machine.

FIG. 1 is a sectional view schematically showing an electrophotographic copying machine embodying the invention. This machine has the same copying mechanism as conventional electrophotographic copying machines having two developing units. The copying machine has centrally thereof a photosensitive drum 1 drivingly rotatable counterclockwise. Provided around the drum 1 are a subcharger 2, eraser lamp 3, main charger 4, character writing unit 5*a*, second developing unit 6, transfer charger 7, charger 8 for separating off copy paper, blade-type cleaner 9, etc. which are arranged in the order mentioned. The character writing unit 5*a* is installed in a mount portion 44 and is changeable for the developing unit 5*b* or outline image forming unit 5*c* to be described later.

The photosensitive drum 1 is a drum having a photosensitive material (e.g. selenium) over its surface. In every copying cycle, the drum 1 is irradiated with the light of the eraser lamp 3, sensitized with the charger 4 and then exposed to an image from an optical system.

The optical system is disposed under a document support glass plate 11 so as to scan the image of an original thereon. A cover 10 is provided over the glass plate 11. The optical system comprises a light source 12, first mirror 13, second mirror 14, third mirror 15, projection lens 16 and fourth mirror 17. As indicated by a dot-and-dash line 18, the original image reaches the drum 1 via the mirrors 13, 14, 15 and 17. A home position switch 50 is provided for detecting whether the optical system is in position for starting scanning. A switch 51 is provided for producing a timing signal for rotating timing rollers 27 at a magnification of X1. The system is set to a desired magnification by shifting the projection lens 16 axially thereof with an unillustrated motor. When scanning the original, the optical system is driven by an unillustrated motor. At a magnification of m, a slider carrying the light source 12 and the first mirror 13 travels leftward at a velocity of v/m as timed with the drum 1 which is rotated at a peripheral velocity of v (constant regardless of the variations in magnification). At the same time, a slider carrying the second mirror 14 and the third mirror 15 travels leftward at a velocity of v/2 m. With the travel of these sliders, the original image is projected from the fourth mirror 17 onto the drum 1 in the form of a slit.

The image thus projected forms an electrostatic latent image on the drum 1. A color (red or blue) toner or black toner is supplied from the developing unit **5*b* (when installed) or the developing unit 6** to the drum, forming a toner image on the latent image.

The copying machine is provided at its left side with automatic paper feed cassettes 20 and 21 inserted in an upper feed opening and a lower feed opening, respectively. Paper is fed selectively from one of the cassettes 20, 21 to the interior of the body of the copying machine by the corresponding one of feed rollers 22 and 23. The paper is passed between a pair of transport rollers 26, transported to the above-mentioned timing rollers 27 in pressing contact with each other and temporarily held in this position. The paper is thereafter forwarded again as timed with the image formed on the drum 1.

For image transfer, the paper forwarded by the timing rollers 27 is brought into intimate contact with the photosensitive drum 1 at a transfer station, where the toner image is transferred onto the paper by the corona discharge of the transfer charger 7. Subsequently, the paper is separated from the drum 1 by the corona discharge of the separating charger 8 and by virtue of the stiffness of the paper itself. The paper is then transported rightward with the clockwise travel of a conveyor belt 28 provided with unillustrated air suction means while being held attracted to the belt. The paper thereafter passes through a fixing unit 29, whereby the toner image is fixed to the paper on melting. The paper is delivered onto a tray 30 outside the machine body.

Switches 52, 54 and 53, 54 are microswitches provided for the cassettes 20 and 21, respectively, for detecting the kind of paper therein and the insertion or removal of the cassette.

The character writing unit **5*a* is detachably installed in the mount portion 44 which is disposed between the point of exposure, 1*a*, on the drum 1 and the second developing unit 6. The unit 5*a* is placed into the mount portion 44 which is a space defined by a frame 42 of the machine body and a unit support table 43 after opening a hinged cover 41 of the body. A connector 46 is attached to a connector mount plate 45 fixed to the body frame 42. The unit 5*a* is electrically connected to the connector 46 by a connector 62 attached to a mount plate 61 fixed to the unit 5*a*. The unit 5*a* is locked to the side plates of the body frame with a lock bar 64 by manipulating a lock lever 63 attached to the rear portion of the unit 5*a***.

Figure 2:
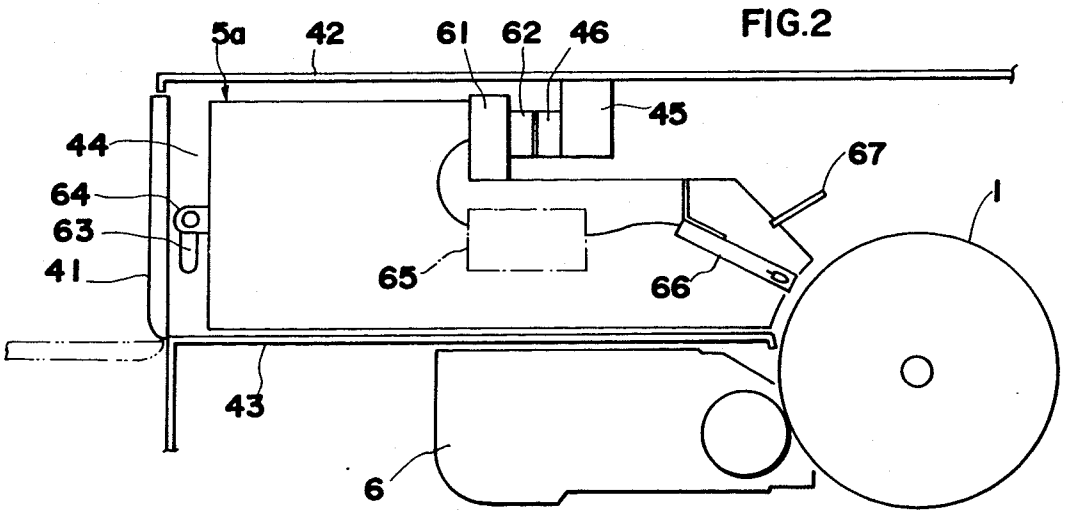
FIG. 2 is an enlarged fragmentary view in section of the copying machine with a character writing unit installed therein.
Figure 4:
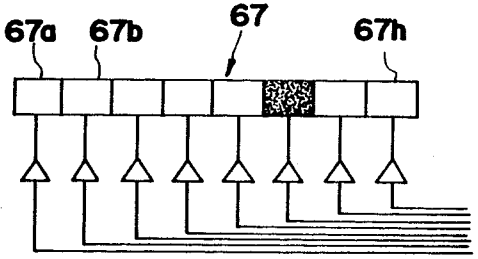
FIG. 4 is a diagram showing a liquid-crystal shutter.
Figure 3:
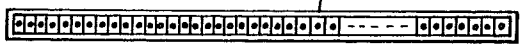
FIG. 3 is a diagram showing an array of LEDs.
Figure 5:
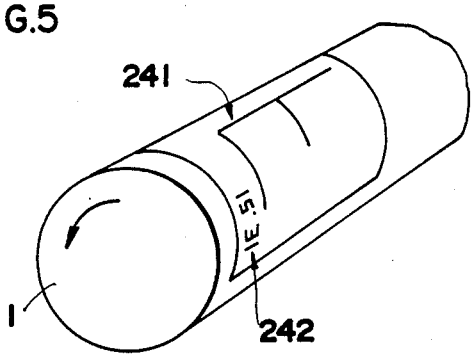
FIG. 5 is a diagram showing an example of data written.

FIG. 2 is an enlarged fragmentary view showing the character writing unit **5*a* as installed in the mount portion 44. Singals are sent through the connectors 46 and 62 to a circuit on a control board 65 and then to an LED array 66 and a liquid-crystal shutter 67. As seen in FIG. 3, the array 66 comprises LEDs arranged in a row at a 1-mm pitch. With reference to FIG. 4, the liquid-crystal shutter 67 comprises eight 40-mm-wide blocks 67*a* to 67*h* arranged along the drum surface and each controllable independently of the others. When characters are to be written, the light is blocked with a corresponding block or blocks of the shutter 67, and the desired LEDs only of the LED array 66 are turned on. FIG. 5 shows an example of data, i.e. the date "12. 31" 242, thus written in an image 241** of an original.

Figure 6:
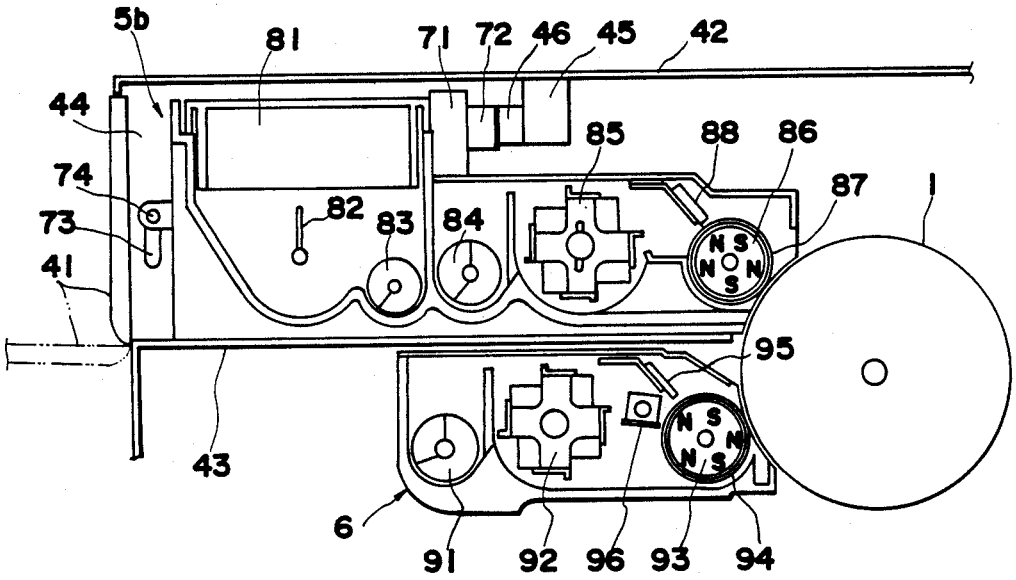
FIG. 6 is an enlarged fragmentary view in section of the copying machine with a color developing unit installed therein.

FIG. 6 shows the color developing unit **5*b* as installed in the mount portion 44. Like the character writing unit 5*a*, this unit 5*b* is electrically connected to the connector 46 on the machine body by a connector 72 attached to a mount plate 71 on the unit 5*b* and is locked to the side plates of the body frame with a lock bar 74 by manipulating a lock lever 73**.

The color developing unit **5*b* is similar to conventional developing units in construction. A toner hopper 81 contains a color toner, which is agitated by the rotation of an agitating member 82 and then sent to a bucket roller 85 by the rotation of a replenishment conveyor screw 83 and a conveyor screw 84. The rotation of the bucket roller 85 further feeds the toner to a sleeve 87 rotating around a fixed magnet roller 86. While being restricted by a doctor blade 88, the toner is then applied to the drum 1 to develop the electrostatic latent image on the drum 1**.

The second developing unit 6 also has the same construction as above. The black toner is transported to a bucket roller 92 by a conveyor screw 91 and further fed to the drum 1 by a sleeve 94 rotating around a fixed magnet roller 93 while being restricted by a doctor blade 95 to develop the latent image. A toner blocking shutter 96 operates during color development (by the color developing unit **5*b*) to interrupt the supply of toner from the bucket roller 92 to the sleeve 94**.

Figure 7:
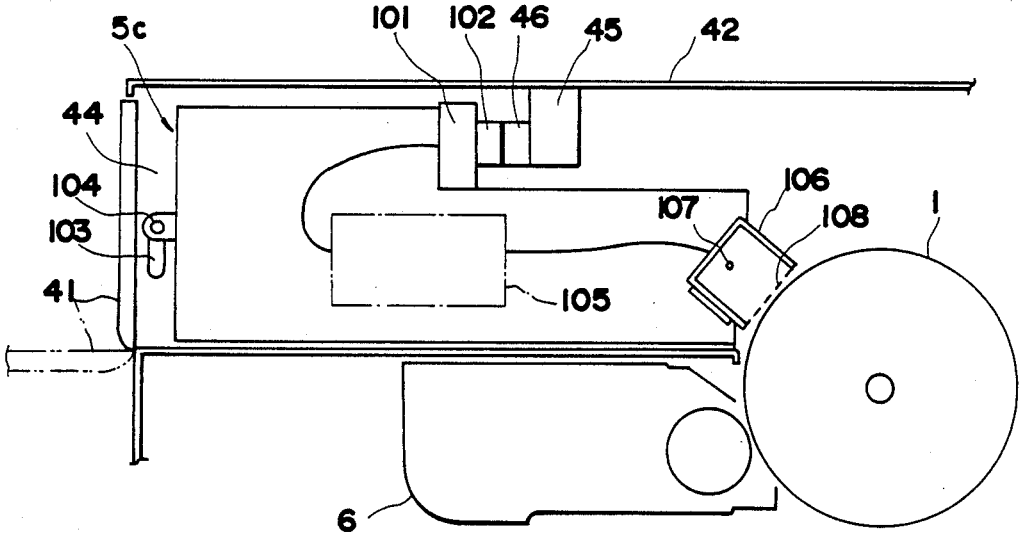
FIG. 7 is an enlarged fragmentary view in section of the copying machine with an outline image forming unit installed therein.

FIG. 7 shows the outline image forming unit **5*c* as installed in the mount portion 44. This unit 5*c* is electrically connected to the connector 46 on the machine body by a connector 102 attached to a mount plate 101 fixed to the unit 5*c*. The unit 5*c* is locked to the side plate of the machine body with a lock bar 104 by manipulating a lock lever 103 provided on the rear side of the unit 5*c***.

Figure 8:
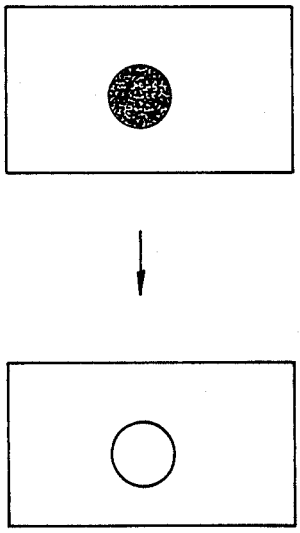
FIG. 8 is a diagram showing an example of outline image formed.

When a signal is fed to the outline image forming unit **5*c* via the connectors 46 and 102, a high-voltage unit 105 produces a d.c. high voltage opposite in polarity to the main charger 4 to apply the voltage to the charge wire 107 of a scorotron charger 106. The scorotron charger 106 has a grit 108, to which a voltage opposite in polarity to that of the charge wire 107** is applied. These voltages are so determined that the electrostatic latent image remains only at its outline as seen in FIG. 8. (For details, see U.S. Pat. No. 4,745,437 already filed by the present applicant and granted.)

Figure 9:
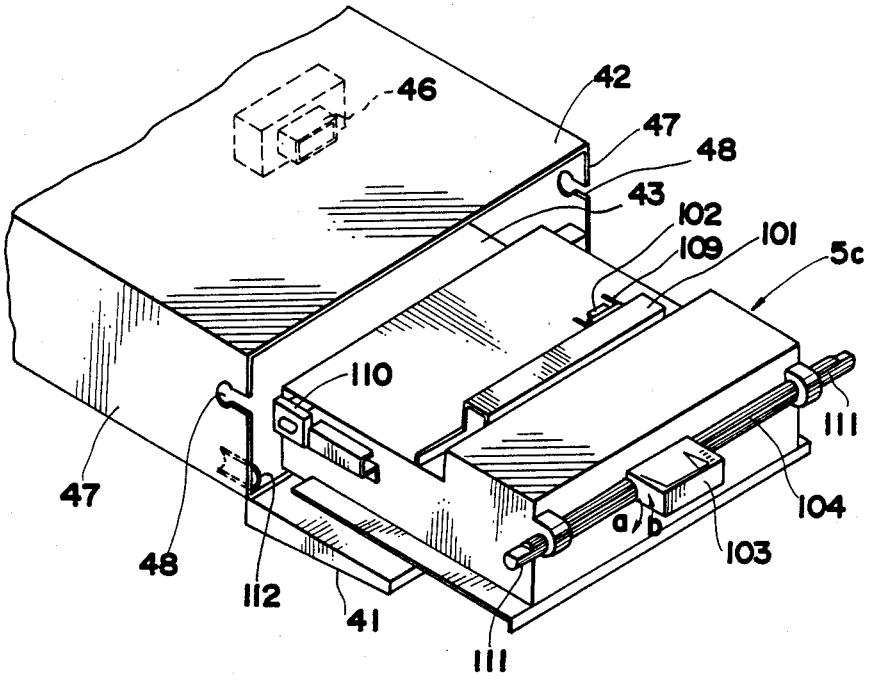
FIG. 9 is a perspective view showing how to install the outline image forming unit in the body of the copying machine.
Figure 10A:
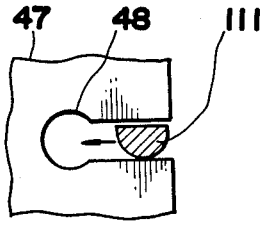
FIGS. 10 (*a*) and (*b*) are fragmentary sectional views showing how to lock the outline image forming unit in the machine body.
Figure 10B:
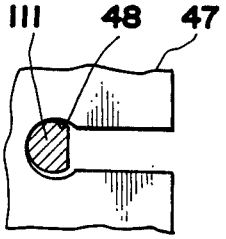

FIG. 9 is a perspective view showing the relation between the outline image forming unit 5c and the body of the copying machine. The connector 102 is attached to the mount plate 101 which is secured to the upper portion of the unit 5c approximately centrally thereof. The connector 102 has pins 109 for connection to the connector 46 on the machine body. On the other hand, a member 110 for fixing the scorotron charger 106 is secured to a side front portion of the unit 5c. The lock bar 104 is rotatably provided on the rear portion of the unit 5c and formed at each of its opposite ends with a cut portion 111 which is generally D-shaped in cross section. The lock lever 103 is secured to the midportion of the lock bar 104. The lock lever 103, when rotated, rotates the lock bar 104, changing the orientation of the cut portion 111. With reference to FIG. 10, each side plate 47 of the body frame is formed with a lock bar engaging portion 48 for engaging the cut portion 111 of the lock lever 103. Attached to an inside lower portion of the side plate 47 is a plate spring 112 for holding the side portion of the unit 5c.

The unit 5c is inserted into the mount portion 44 in the machine body after opening the cover 41 of the body. When the unit 5c is to be inserted, the lock lever 103 is turned upward (in the direction of b) to position the lock bar 104 (each cut portion 111) in the state shown in FIG. 10 (*a*), and the unit 5c is placed in sliding contact with the unit support table 43. When the unit 5c has been inserted to the installed position, the connector 102 on the unit 5c is joined to the connector 46 on the machine body, with the cut portion 111 at each end of the lock bar 104 brought into contact with the large-diameter part of the engaging portion 48, whereby the unit 5c is positioned in place. The unit 5c is then locked by turning the lock lever 103 downward (in the direction a) through 90 degrees to position the lock bar 104 in the state of FIG. 10 (*b*). The unit 5c is removable from the machine body by turning the lock lever 103 upward (direction b) through 90 degrees to rotate the lock bar 104 to the orientation shown in FIG. 10 (*a*), and then withdrawing the unit 5c with the lever 103 so turned. When installed, the unit 5c is restrained by the plate spring 112 from moving laterally.

The arrangement for and method of installing or removing the character writing unit 5a and the developing unit 5b shown in FIGS. 2 and 6 are the same as in the case of the outline image forming unit 5c.

Figure 11:
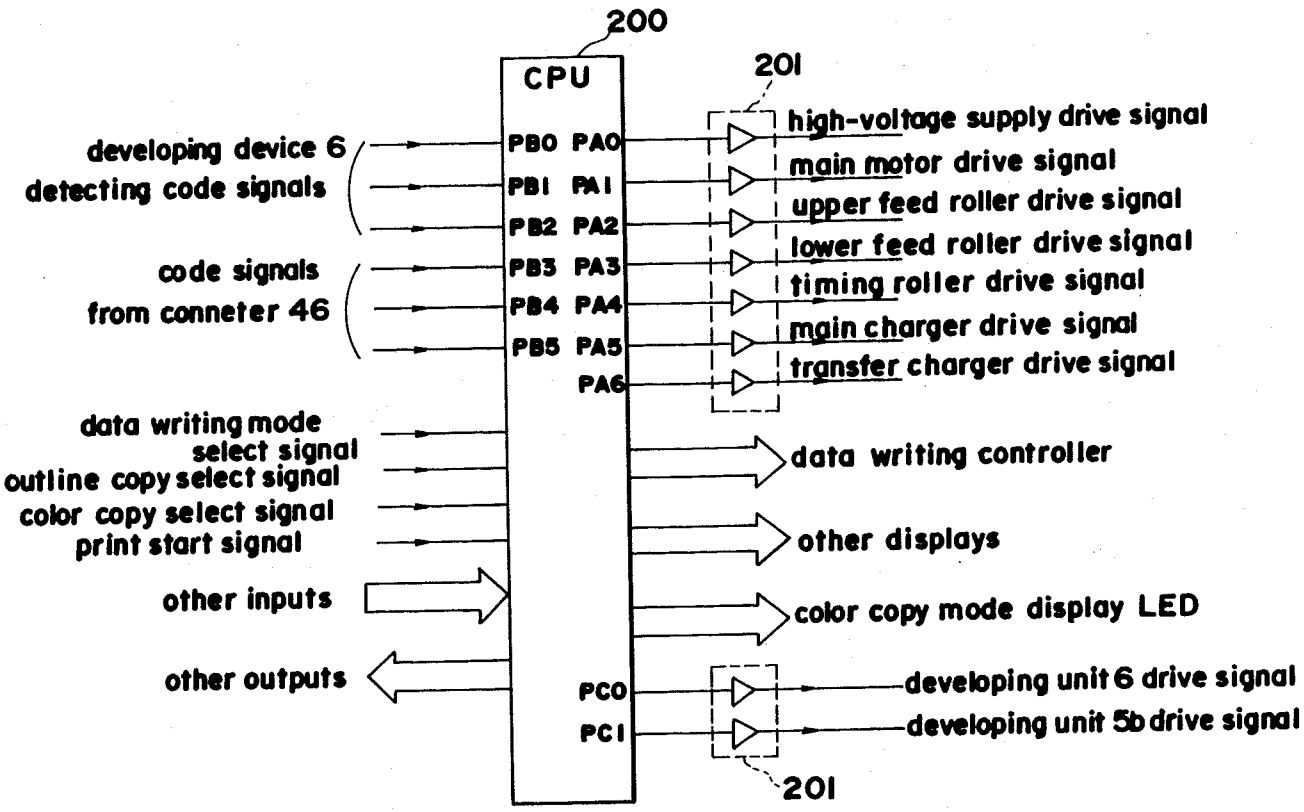
FIG. 11 is a diagram schematically showing the control circuit of, the copying machine.

FIG. 11 is a diagram showing the control circuit of the present embodiment including one-chip microcomputer 200.

The microcomputer 200 receives data as to the control of the copying machine and sends out data to peripheral circuits.

Indicated at 201 is a driver IC for driving the main motor, etc. Indicated at PA0 to PA6 are output ports for controlling the high-voltage supply 105 within the outline image forming unit 5c, main motor, solenoids for driving the upper and lower feed rollers 22, 23, solenoid for driving the timing roller 27, main charger and transfer charger, respectively.

Indicated at PC0 and PC1 are also output ports for controlling clutches for driving the second developing unit 6 and the developing unit 5b. Input ports PB0 to PB5 receive 3-bit codes for identifying the second developing unit 6 and the unit installed in the mount portion 44 and the color of toner in each unit in use. The microcomputer (CPU) 200 further controls various outputs of and displays for a data writing controller, etc. An unillustrated operation panel is use for setting various modes and data.

(b) Control process for copying machine per se

Figure 12:
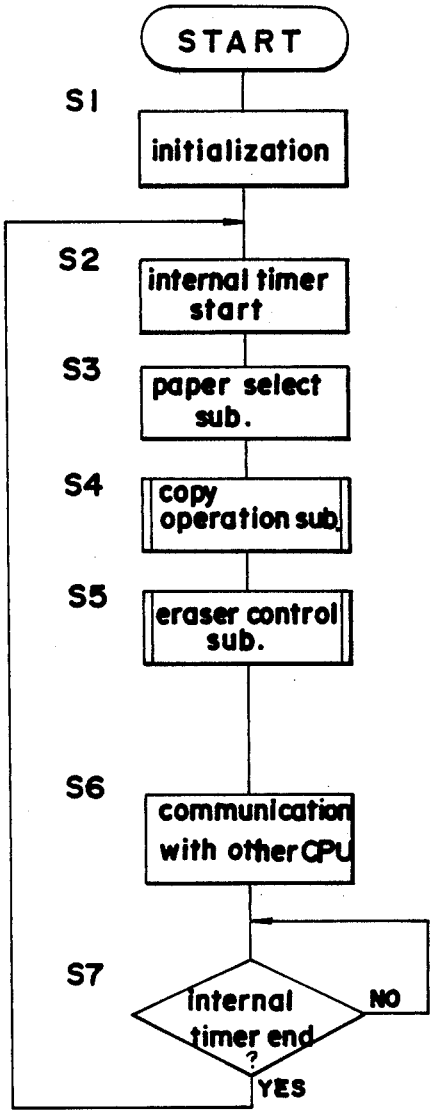
FIG. 12 is a main flow chart showing the control process for the copying machine.

FIG. 12 is a flow chart generally showing the control process to be executed by the CPU 200 for the copying machine. When the CPU 200 is reset for the start of the contemplated program, step S1 is performed for initialization wherein various registers are set, the CPU is initialized and the machine is set in an initial mode.

Next, an internal timer is started (step S2) which is included in the CPU and already set to a value by the initialization.

Subsequently, the subroutines (steps S3 to S6) shown in the flow chart are executed in succession. In the copy paper select routine (step S3), the desired copy paper size is selected. The copying operation routine of step S4 is performed to execute a copying operation. When the character writing unit 5a is installed in the mount portion 44, the eraser control routine of step S5 is performed to control the operation of the LED array 66 and the liquid-crystal shutter 67.

On completion of all the subroutines, the CPU 200 performs data communication with other CPU (step S6). With the completion of operation of the internal timer initially set (step S8), one routine is completed. The time interval of this one routine is used for the counting operation of the timers employed in the subroutines. (The value of each timer indicating the completion of its operation is dependent on how many time the routine is counted.)

Figure 13A:
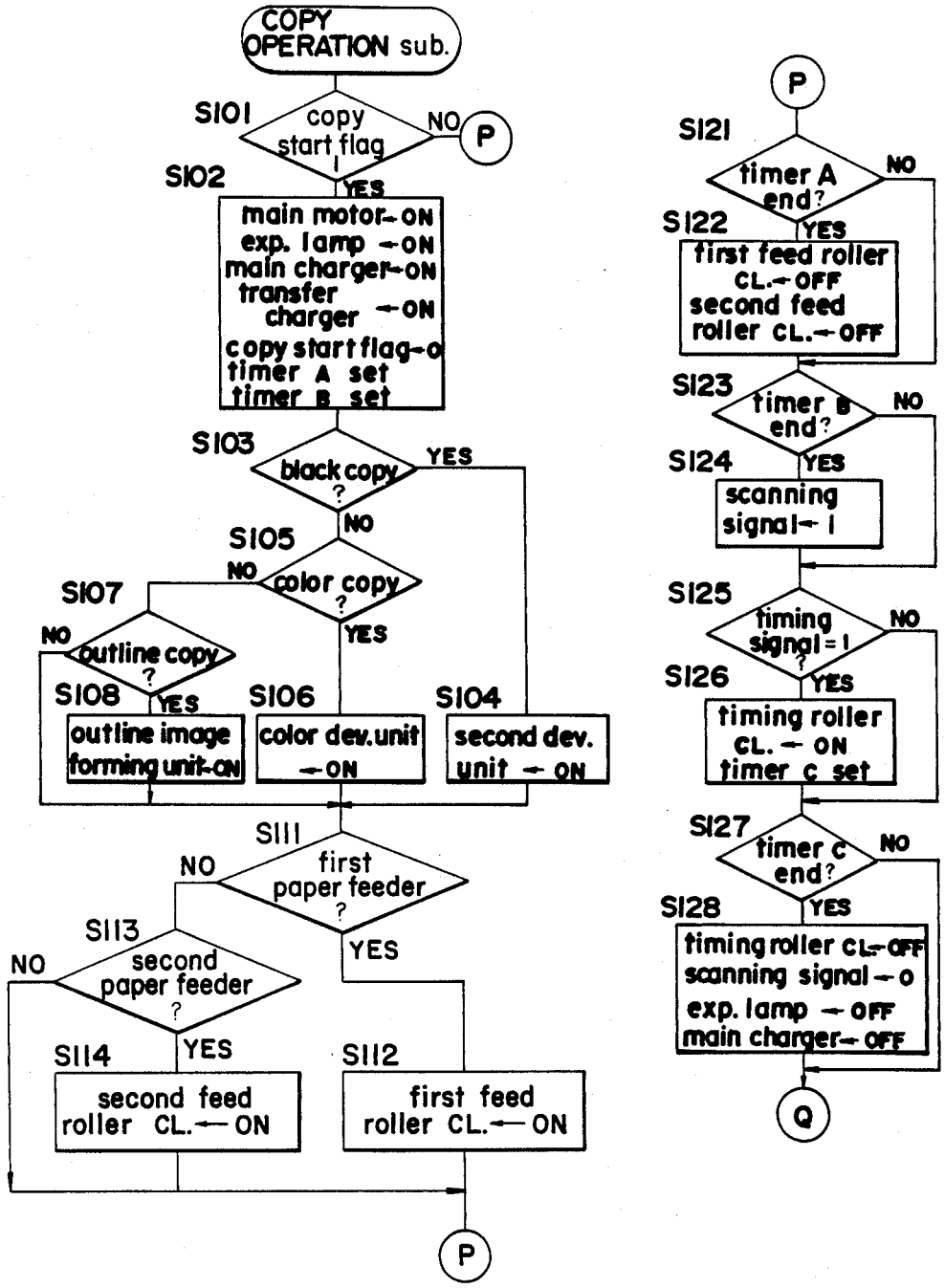
FIGS. 13(*a*) and 13(*b*) are a flow chart showing a copying operation.
Figure 13B:
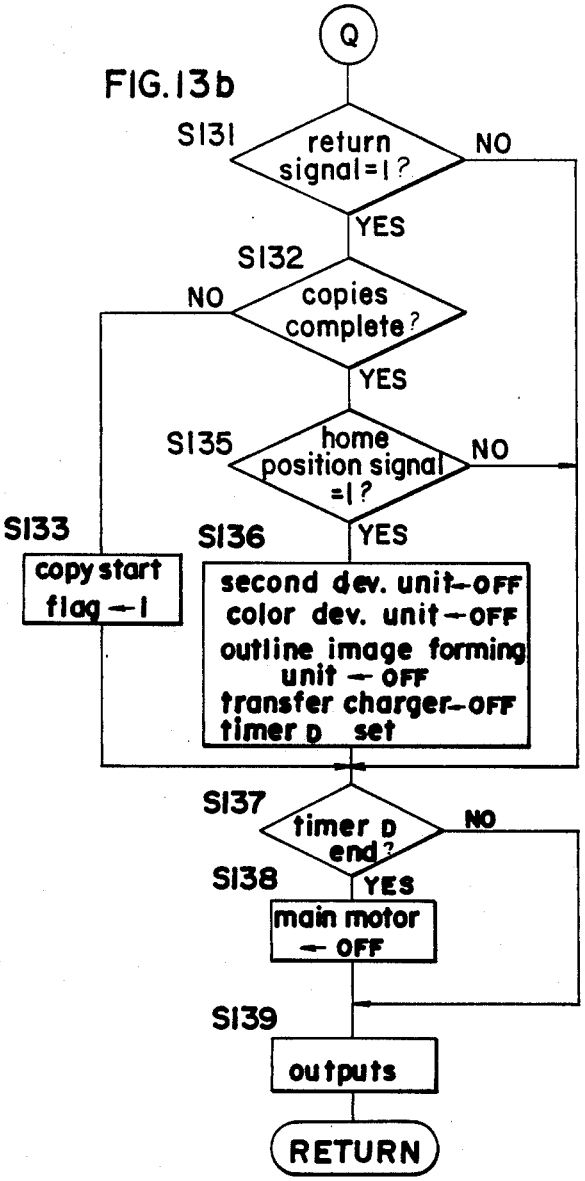

FIG. 13 is a flow chart showing the copying operation subroutine (step S4). First, step S101 checks a copy start flag as to whether it is "1". When it is "1", step S102 follows to drive the main motor and the photosensitive drum 1 and set the paper transport rollers, etc. in condition for rotation. Further the exposure lamp 12, the chargers 2, 4 and the transfer charger 7 are turned on, and the copy start flag is reset to "0". A timer A for controlling the paper transport system and a timer B for controlling the optical system are set.

Next, if "black copy" is specified by the operator using the unillustrated operation panel (step S103), the second developing unit 6 is operated (step S104). If "color copy" is specified (step S105), the color developing unit 5b is operated (step S106). If "outline copy" is specified (step S107), the outline image forming unit 5c is operated (step S108).

Step S111 now checks whether the first paper feeder is selected, or step S112 inquires whether the second paper feeder is selected. Step S112 or S114 then engages the feed roller clutch of the selected feeder to feed a sheet of copy paper. The sequence proceeds to step S121.

When the completion of operation of the timer A is detected in step S121, the first or second feed roller clutch is disengaged in step S122. When the completion of operation of the timer B is detected in step S123, a scanning signal is turned on in step S124, initiating the optical system into travel for scanning an original.

Next, step S125 inquires whether a timing signal is on, that is, whether the timing switch 51 on the path of scanning of the optical system is on, indicating that it is the time for the pair of timing rollers 27 to forward the copy paper. When the answer to the inquiry is in the affirmative, the timing roller clutch is engaged to feed the paper to the transfer station and a timer C is set in step S126. On completion of operation of the timer C in step S127, step S128 follows to disengage the timing roller clutch, turn off the scanning signal and also turn off the exposure lamp 12 and the main charger 4.

After a return signal is turned on in step S131, i.e. after the optical system has started to return from the scanning completed position toward the home position, step S132 inquires whether a number of copies have been completed as specified. If the answer is negative, the copy start flag is set to "1" again in step S133. If the answer is affirmative, step S135 follows to recognize that the optical system has returned to the position to start its travel by the actuation of the home position switch 50. To complete the copying operation, step S136 thereafter turns off the developing motor or the outline image forming charger, and the transfer charger 7 and sets a timer D. On completion of operation of the timer D in step S137, the main motor is turned off in step S138 to stop the drum 1. The subsequent step S139 outputs the processed result, whereupon the sequence returns to the main routine.

Figure 14:
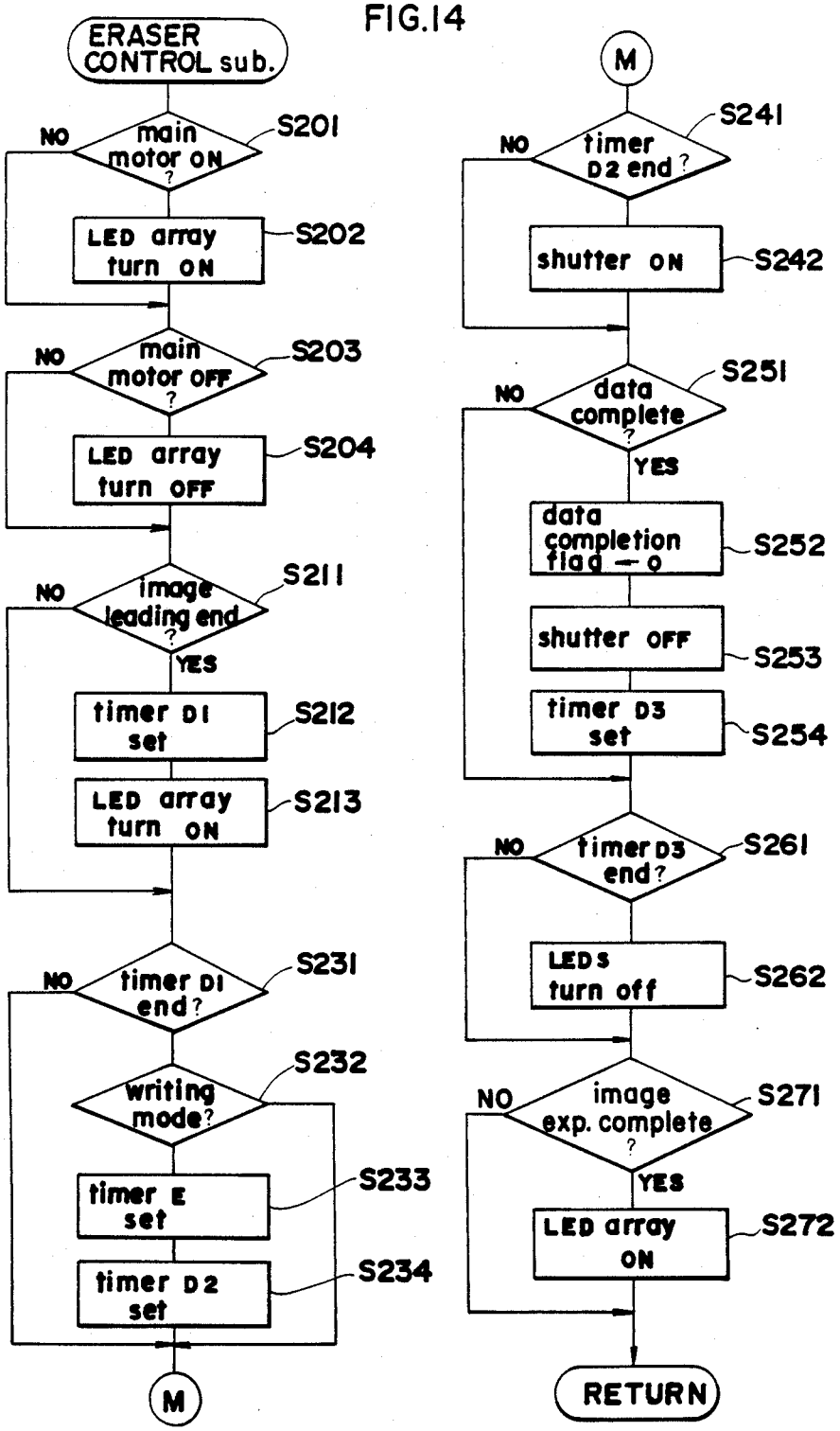
FIG. 14 is a flow chart showing an eraser control routine.

FIG. 14 is a flow chart showing the eraser control subroutine for controlling the liquid-crystal shutter 67 and the LED array 66. The data writing LED array 66 is entirely turned on in step S202 when the main motor in off state is turned on (step S201). Further the LED array 66 is entirely turned off in step S204 when the main motor in on state is turned off (step S203).

When the scanner of the optical system turns on the image leading end switch 50 (step S211), an image exposure is started. At this time, a timer D1 is started (step S212) for an interval of time from the image leading end to the area where data is to be written. Further according to the copying magnification, the LED array 66 is turned on (step S213).

The operation of the timer D1 is completed in step S231, whereupon if the machine is in a writing mode in compliance with a character writing instruction given by the operator through the operation panel (step S232), a timer E and a timer D2 are started (steps S233 and S234). On completion of operation of the time E, an interrupt is made (see FIG. 15) for data writing. The value of the timer E is an interval of on-time per item of data for each LED of the LED array 66. The timer D2 is for an interval of time from the start position of the writing area to the writing position.

On completion of operation of the timer D2 (step S241), the liquid-crystal shutter 67 is actuated to close the optical path (step S242).

When the data has been completed (step S251), a data completion flag is set to 0 (step S252), and the liquid-crystal shutter 67 is turned off to open the optical path (step S253). A timer D3 is then started (step S254) for an interval of time from the writing completion position to the end position of the writing area.

On completion of operation of the timer D3 (step S261), the LEDs on are turned off (step S262).

When the image exposure is completed (step S271), the LED array 66 is entirely turned off (step S272).

Figure 15:
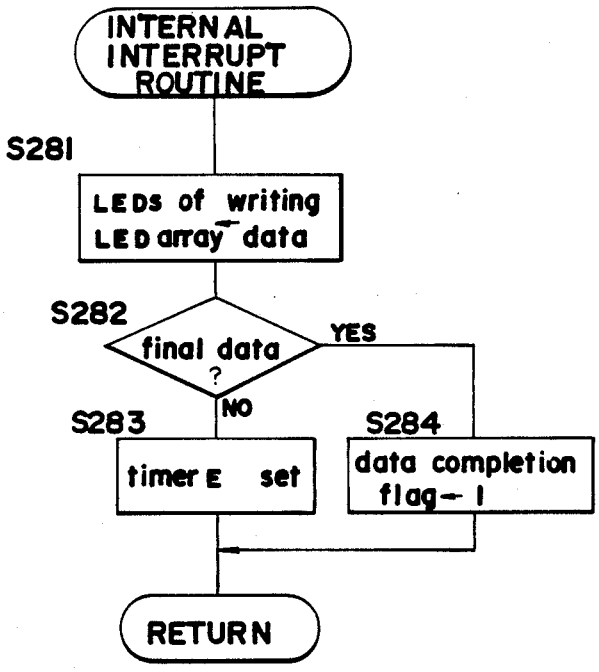
FIG. 15 is a flow chart showing an internal interrupt routine.

FIG. 15 shows an internal interrupt routine which is to be executed on completion of operation of the internal timer E. When the timer E has completed its operation, an internal interrupt is made to control the LEDs of the LED array 66 with writing data forwarded from the CPU. More specifically, the light-emitting diodes of the array 66 are turned on according to the data to be written (step S281). Unless the item of data thus recorded is the final one (step S282), the timer E is set (step S283), whereas if it is the final one, the data completion flag is set to "1" (step S284). If the internal timer E is not set, no interrupt is made, so that the setting of the data completion flag to "1" terminates the interrupt process.

As will be apparent from the above description, one of the different units is selectively usable for the copying machine according to the invention. This makes the main body of the machine available without a cost increase, while enabling the user to purchase only the unit of the desired function and to additionally purchase another desired unit. The functional components to be arranged around the drum can also be designed without difficulties.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A copying machine, which is capable of executing an copying operation in a first copying mode, a second copying mode and a third copying mode, comprising;
   - charging means for charging a photosensitive member to a predetermined potential;
   - optical means for projecting an image of an original onto the photosensitive member charged by the charging means to form an electrostatic latent image thereon;
   - developing means for developing the latent image on the photosensitive member;
   - a mount portion provided between the position of image projection by the optical means and developing means;
   - a developing unit, which is detachably mountable in the mount portion, for developing the latent image on the photosensitive member as mounted in the mount portion in the first copying mode;
   - a character writing unit, which is detachably mountable in the mount portion, for forming an electrostatic latent image of additional data on the photosensitive member having the original latent image formed by the optical means as mounted in the mount portion in the second copying mode;
   - a outline image forming unit, which is detachably mountable in the mount portion, for extracting outlines of the latent image formed by the optical means as mounted in the mount portion in the third copying mode, wherein one of said units is selectively mounted in the mount portion in accordance with the copying mode; and
   - control means for outputting control signals to said unit selectively mounted in the mount portion in accordance with the copying mode.

2. A copying machine as claimed in claim 1 wherein the developing unit has developing toner of which color is different from the developing color of the developing means and is operable in accordance with the control signals from the control means in the first copying mode.

3. A copying machine as claimed in claim 1 wherein said character writing unit has an array of light emitting elements which are independently controllable in accordance with the control signals sent from the control means in the second copying mode.

4. A copying machine as claimed in claim 1 wherein said outline image forming unit has a scorotron charger and a high-voltage unit which produces a d.c. high voltage opposite in polarity to the charging means to apply the voltage to said scorotron charger in accordance with the control signals sent from the control means in the third copying mode.

5. A copying machine comprising:

a photosensitive member which is rotatably mounted;

charging means for charging a photosensitive drum to a predetermined potential;

optical means for projecting an image of an original onto the photosensitive member charged by the charging means to form an electrostatic latent image thereon;

developing means for the developing the latent image on the photosensitive member; and a mount portion provided between the position of image projection by the optical means and developing means;

one of a developing unit, a character writing unit and an outline image forming unit being selectively detachably mountable in the mount portion in the direction perpendicular to an axis of the photosensitive member, the developing unit being operable as mounted in position to develop the latent image on the photosensitive member, the character writing unit being operable as mounted in position to form an electrostatic latent image of additional data on the photosensitive member, the outline image forming unit being operable as mounted in position to impart a specified potential to the latent image on the photosensitive member and extract only the outline of the latent image.

6. A copying machine as claimed in claim 5 further comprising connector means provided at the mount portion for electrically connecting one of the units which is placed into the mount portion and wherein said developing unit, said character writing unit and said outline forming unit respectively have connectors which are connectable to said connector means.

7. A copying machine comprising:

charging means for charging a photosensitive member to a predetermined potential;

optical means for projecting an image of an original onto the photosensitive member charged by the charging means to form an electrostatic latent image thereon;

developing means for the developing the latent image on the photosensitive member;

a mount portion provided between the position of image projection by the optical means and developing means;

one of a developing unit, a character writing unit and an outline image forming unit being selectively detachably mountable in the mount portion, the developing unit being operable as mounted in position to develop the latent image on the photosensitive member, the character writing unit being operable as mounted in position to form an electrostatic latent image of additional data on the photosensitive member, the outline image forming unit being operable as mounted in position to impart a specified potential to the latent image on the photosensitive member and extract only the outline of the latent image;

connector means provided at the mounting portion for electrically connecting to said unit selectively mounted on the mount portion; and control means for outputting control signals to said mounted unit through the connector means to control the mounted unit.

8. A copying machine as claimed in claim 7 wherein the developing unit has developing toner of which color is different from the developing color of the developing means and is operable in accordance with the control signals from the control means.

9. A copying machine as claimed in claim 7 wherein said character writing unit has an array of light emitting elements which are independently controllable in accordance with the control signals sent from the control means.

10. A copying machine as claimed in claim 7 wherein said outline image forming unit has a scorotron charger and a high-voltage unit produces a d.c. high voltage opposite in polarity to the charging means to apply the voltage to said scorotron charger in accordance with the control signals sent from the control means.

* * * * *